US005212908A

United States Patent [19]

Norman

[11] Patent Number: 5,212,908

[45] Date of Patent: May 25, 1993

[54] CELL DOOR OPERATING SYSTEM

[75] Inventor: Richard O. Norman, San Antonio, Tex.

[73] Assignee: Adtec, Incorporated, San Antonio, Tex.

[21] Appl. No.: 728,697

[22] Filed: Jul. 11, 1991

[51] Int. Cl.[5] ..... E05B 47/06; E05F 15/10

[52] U.S. Cl. ..... 49/18; 49/28; 49/30; 49/139; 49/506

[58] Field of Search ..... 49/15, 18, 20, 16, 17, 49/139, 140, 28, 30, 506

[56] References Cited

U.S. PATENT DOCUMENTS

| | | | |
|---|---|---|---|
| 2,792,917 | 5/1957 | Smith et al. | 49/17 |
| 2,837,182 | 6/1958 | White | 49/18 |
| 2,841,252 | 7/1958 | Adam | 49/16 |
| 3,866,354 | 2/1975 | Butt | 49/16 |
| 4,621,451 | 11/1986 | Bruehler | 49/15 X |
| 4,686,598 | 8/1987 | Herr | 49/28 X |
| 4,897,959 | 2/1990 | Worden | 49/18 |
| 4,912,878 | 4/1990 | Bentley | 49/15 X |
| 5,040,331 | 8/1991 | Merendino et al. | 49/30 X |

*Primary Examiner*—Philip C. Kannan
*Attorney, Agent, or Firm*—Gunn, Lee & Miller

[57] ABSTRACT

A symmetrical cell door and operating system comprises a vertically shiftable locking bar mounted in a center column of a cell opening. A cell door is movable in either direction relative to the central column and has upwardly facing locking notches in a lower horizontal frame element to receive the lower end of the locking bar to lock the cell door when moved either to the extreme right or to the extreme left of the center column. An elongated rack is secured to the top of the cell door by a lost motion connection and defines a cam slot engagable with a horizontally projecting actuator on the locking rod to cam the locking bar into and out of the respective locking notch. The rack is reciprocated by a pinion driven by a DC motor. Two separate banks of batteries selectively supply power to the DC motor and one bank is always being charged, thus eliminating the need for a mechanical backup system for concurrently opening or closing all cell doors in the event of a failure of the AC power supply to the building.

19 Claims, 6 Drawing Sheets

CELL DOOR OPERATING SYSTEM

BACKGROUND OF THE INVENTION

1. Field of the Invention

The invention relates to an operating and locking system for jail cell doors, including both a novel apparatus and method of operating same.

2. Summary of the Prior Art

For the past thirty years, the construction and operation of slidable type doors for jail cells has not been significantly changed. Each cell door is moved from a closed, locked position to an open position by an elongated rack element linearly movably mounted in a steel housing assembly constituting a top frame for the cell door and providing a horizontal track for rollers supporting the cell door. Such rack is driven by a pinion which in turn is rotated by a reversible AC motor. A lost motion connection is provided between the rack and the cell door. Normally, utility supplied 110 volt AC power is utilized to energize the motor.

The locking of the cell door is usually accomplished by a vertically downward shifting of a steel locking rod which extends downwardly on a central column in the door opening of the cell to engage a locking notch provided in a horizontal steel element forming the bottom portion of the cell door. The locking rod is shifted vertically from its locked to unlocked positions by a cam surface provided in depending relationship to the rack which is engagable with a radially projecting pin carried by the top end of the locking rod. When desired, a secondary locking element may be provided in the opposite side of the door adjacent the top of the door. The secondary locking element is likewise vertically shifted between locked and unlocked positions by a cam mounted in depending relationship to the rack and engagable with a pin projecting radially from the locking rod. The secondary locking rod cooperates with a notch or hole formed in the steel frame assembly which extends across the entire width of the cell and provides a housing for the roller track, the rack, the motor driven pinion and a mechanical backup unlocking mechanism to be described. The lost motion connection between the rack and the cell door permits initial movement of the rack to release the locking element and rod before an opening force is applied to the cell door.

The employment of utility supplied AC power as the driving energy for cell door locking and opening mechanisms is subject to several well known disadvantages. In the first place, penitentiaries are generally located in rural areas, and the utility service, if interrupted, generally requires a substantial period of time before service can be restored. If expensive diesel powered backup generators are provided, valuable time is wasted in starting the diesel engine and bringing the generator up to operational speed. Even more importantly, by utilizing AC electric motors to move the cell door from an open to a closed position, thermal cut-off of such motors is often produced by the cell occupants placing obstructions between the vertical edge of the cell door and the frame against which the door abuts in its closed position to prevent the door from reaching its closed position. Under such circumstances, the stalled 110 volt AC motor heats up in a fairly short time and a thermal overload switch conventionally incorporated within the housing of such motor opens. While this protect the motor from damage, it inherently involves a delay of at least a half hour for the motor to cool sufficiently to permit the thermal switch to be reset and the motor restored to an operating condition. During this time period, the cell door remains in its partially open position and, of course, can be manually moved or pried to a sufficiently open position to permit the cell occupant to exit from the cell.

To overcome these disadvantages, the prior art cell door operating mechanisms provided two forms of mechanical backup to loss of electrical power. Since it is common to control all of the cell doors in a cell block from a control room located so as to have visibility into all of the cells of a U-shaped cell block, a mechanical door release mechanism was provided comprising a complicated, extensive and expensive linkage which ran through the top portion of all of the cell door operating mechanisms of the cell block, even turning the corners of the U-shaped cell block. Such linkage was supposedly manually operable by a massive lever or a hand wheel mounted in or adjacent to the control room. Thus the total length of this mechanical lock releasing linkage could be on the order of at least 150 ft.. Since linear movement must be imparted to the entire linkage by the lever or hand wheel, the linear rods by which such linear movement is transmitted must be mounted in each cell block in precise alignment with the rods of adjacent cells so that frictional binding of the linkage rods will not occur which would prevent the entire linkage from being shifted by the force manually exertable by the control room guard.

As is well known to those skilled in the art of constructing jails, concrete walls are the preferred and most economical construction, but such walls cannot be accurately fabricated to define precise horizontally aligned, vertical planes, hence brackets secured to the concrete walls for supporting the actuating rods of the prior art mechanical release linkage were seldom aligned. This results in the tedious job of shimming out those portions of the concrete wall which vary horizontally from other portions of the same or other walls, so as to provide horizontally aligned surfaces on which to mount the supporting brackets for the mechanical linkage. This necessity for highly accurate installation of the very lengthy and complex mechanical backup linkage greatly increases the cost of installing a conventional cell door operating system.

Additionally, the mechanical backup linkage is necessarily mounted in a position above the rack provided for the motor operation of each cell door. The common release mechanism operated by the mechanical backup linkage includes a pivoted support frame for the motor driven pinion which drives the rack. Thus the motor driven pinion was first lifted from engagement with the rack. Further movement of the mechanical backup linkage engages the rack structure to move same to release the cell door locking members by the cams carried in depending relationship to the rack. All cell doors can then be manually rolled to their respective open positions.

All of this mechanism must necessarily be mounted above the rack, and the end result is that the total height of the top frame assembly is always 15 inches or more. Normal penitentiary construction involves only an 8 ft. height between the floor and the ceiling. This necessarily means that cell doors in excess of 6 ft. in height cannot be used, and it would be highly desirable if a 7 ft. cell door could be provided within the 8ft. floor to ceiling limitation of the most economical building structure.

Still another disadvantage of the continuous linkage of the mechanical backup mechanism is the fact that if it is not used very often or not lubricated, the frictional drag produced by rust or dirt in the multitude of bearing supports will prevent the manual operation of the linkage. Settling of the building will, of course, distort the alignment of the supporting bearings for the mechanical linkage rods and further effect a bindup of the mechanical backup system.

As mentioned above, in addition to the mechanical backup release mechanism for concurrently shifting all cell doors to an open position, the prior art locking mechanism of each cell door could be individually operated by the insertion of a specially designed key through an opening in a front panel covering the U-shaped channel which mounts the motor driven pinion, the rack, the cell door rollers and the mechanical backup linkage. The rotation of such key by an elongated lever handle will disengage the lifting of the motor driven pinion out of engagement with the rack, and move the rack sufficiently to release the cell door locks so that each cell door may be manually opened in the event of failure of the mechanical backup linkage.

Another major deficiency of prior art cell door locking systems is the fact that four separate designs of cell doors had to be provided by manufacturers in order to meet architect requirements for both right hand and left hand opening doors and right hand and left hand locations of the mechanical backup linkage. A symmetric door which could meet all of the requirements with a single design, was not available.

Lastly, prior art locking systems did not positively lock the cell door in an open position, thereby inviting abuse of the gear drive for the rack engaging pinion.

There is a need, therefore, for an improved cell door construction and operating system which will overcome each of the aforesaid disadvantages and which will occupy less vertical space at the top of the cell door opening, permitting the installation of 7 ft. cell doors.

SUMMARY OF THE INVENTION

A cell door operating system embodying this invention overcomes each of the aforementioned deficiencies of prior art mechanisms and can be manufactured and installed for a substantially lower total cost than prior art systems. The cell door has an operating mechanism having a total height of less than 12 inches. No mechanical backup linkage is required to effect the opening of some or all doors in the event of interruption of the AC power supplied to the prison complex from whatever source. The motors for driving the rack engaged pinion are DC motors, preferably supplied with DC power at 24 volts from one of two separate banks of batteries. One bank of batteries is always being charged while the other bank is on line. The two battery banks are preferably placed in different locations so that a fire or flood in one battery bank location will not affect the viability of the other battery bank. Alternatively, a single battery bank with a floating charger could be employed.

In the event that the batteries are concurrently disabled, each individual cell door can be unlocked by inserting a lever key through an opening in the upper frame housing which is normally closed by a bolted cover. Such lever key is engagable with a horizontally pivoted support for the DC motor and its gear driven pinion lift the pinion out of engagement with the rack. The lever key then makes a lost motion connection with the rack to move the rack in the direction to unlock the cell door. Once this is accomplished the cell door may be readily opened manually.

To overcome the problem of doors not closing, or not fully opening, because of obstacles placed between the vertical edge of the cell door and the vertical wall of the door opening, the method of this invention provides circuitry for each DC motor that acts in response to a predetermined increase in DC current drawn by the motor to immediately interrupt the current flow to the DC motor, thus preventing any overheating of such motor. More importantly, the DC energization voltage for the DC motor is then repeatedly applied, at 3 to 5 second intervals, for only a few milliseconds to determine whether the cell door is still blocked from closing. Thus, overheating of the DC motor is prevented, and, as soon as the obstacle is removed, the DC motor is immediately energized to complete the closing, or opening of the cell door.

An important feature of a cell door locking and operating mechanism embodying this invention is that the total vertical space required above the cell door to house the rack and the DC motor driven pinion is substantially reduced over prior art designs, thus making the installation of a seven ft. height cell door in an eight foot floor to ceiling door opening space completely possible at a substantially lower total cost.

A cell door and its associated operating and locking mechanism embodying this invention is completely symmetrical, permitting the same door to function as either a right hand opening door or a left hand opening door. Moreover, the cell door is as firmly locked in its fully open position as it is in its closed position. This feature obviously eliminates abuse of the door by inmates applying lateral forces to the door when opening which ave to be absorbed by the rack teeth engagement with the rack driving pinion.

The symmetrical design of a cell door embodying this invention is accomplished by the mounting of a vertically shiftable locking bar in a center post or column located in the center of the space provided for the movement of the door between an open or a closed position. Thus the cell door entryway may be selected to be either on the right hand or left hand side of the center column. A pair of upwardly opening notches are provided in the lateral end portions of a bottom frame element of the cell door to respectively receive the bottom end of the locking bar when the cell door is in either into extreme right hand or its extreme left hand position relative to the center column. Thus, regardless of whether the entryway is to the right or left of the central column, the cell door is locked by the vertical locking bar in both its open and closed positions. The vertical locking bar is raised or lowered by a cam track provided on the rack support. A lost motion connection is provided between the rack support frame and the roller mounting frame of the cell door. Thus, the locking bar is released by the initial movement of the rack in either direction from its locked position.

In similar manner, two upper latches are respectively horizontally pivotally mounted adjacent the two ends of the roller frame mounting member of the cell door and respectively engage in two of three horizontally spaced notches formed in the bottom flange of a top frame element rigidly spanning the cell door opening. The upper latches are engaged to lock the cell door in both its open and closed positions regardless of whether the cell entryway is to the right or left of the center column. The upper latches are shifted into and out of engagement with the respective notches by cam tracks on each end of the rack which are respectively traversed by projections secured to the upper latches. Such latches are locked or released by the initial movement of the rack due to the essential lost motion connection between the rack and cell door. Thus, a single door design will accommodate both left hand or right hand entryways and will hereinafter be referred to as a symmetrical cell door.

Further objects and advantages of a cell door operating and locking system embodying this invention will be readily apparent to those skilled in the art from the following detailed description of a preferred embodiment of the invention taken in conjunction with the annexed sheets of drawings.

FIG. is a front elevational view of the left hand upper latch mechanism.

Figure 8:
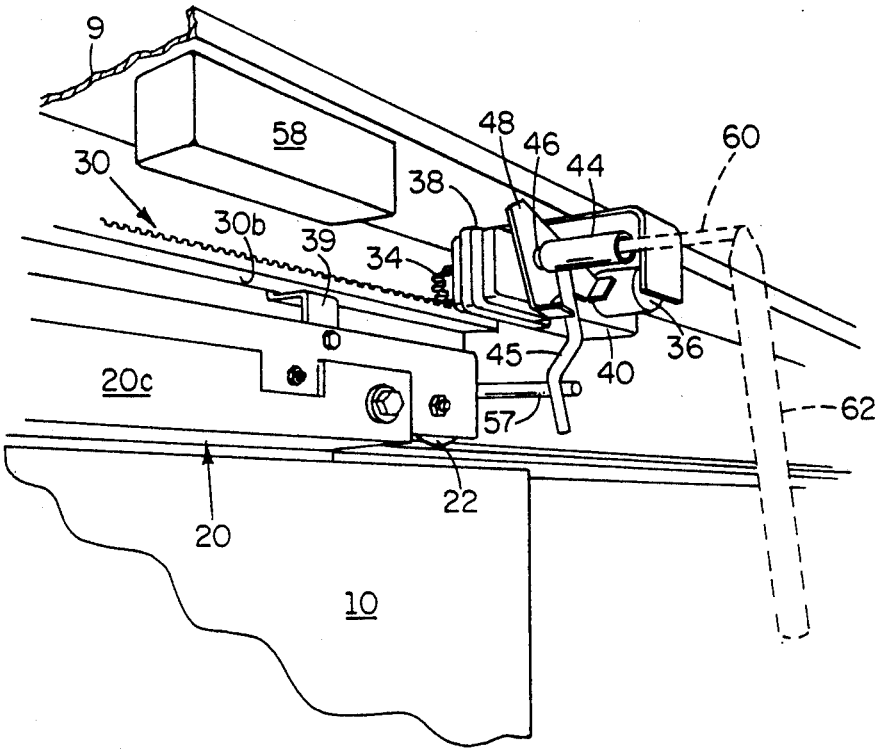

FIG. 8 is a schematic perspective view of the lever key backup operating mechanism for opening the cell door in the event of an electrical failure.

Figure 10:
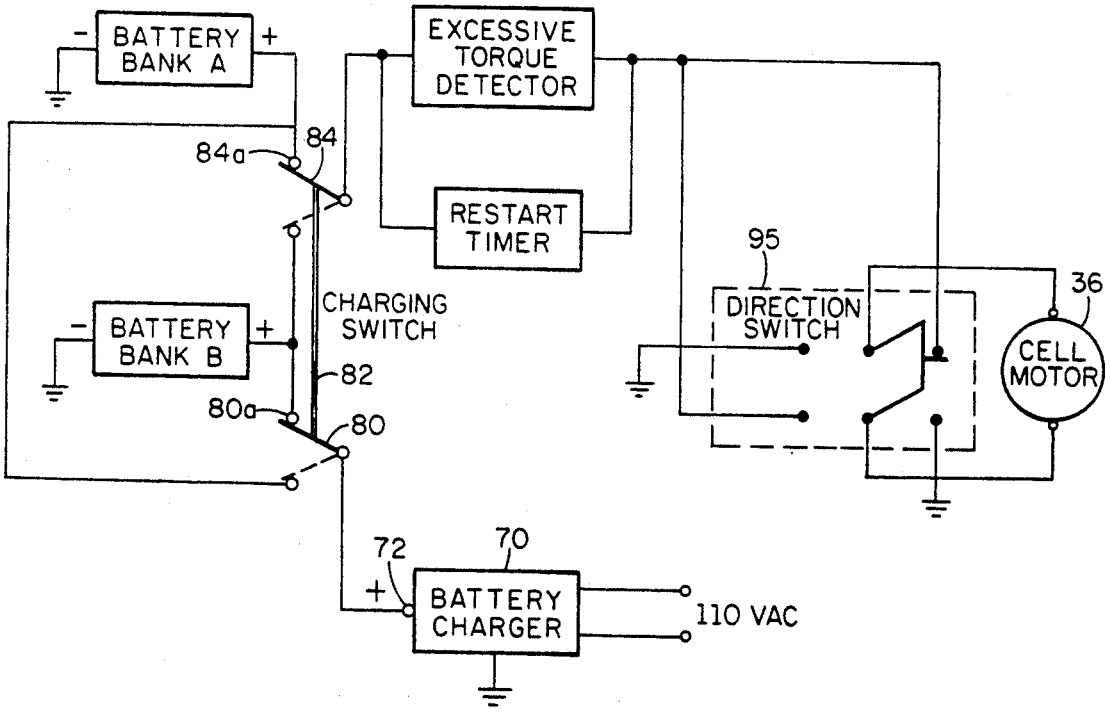
Figure 9:
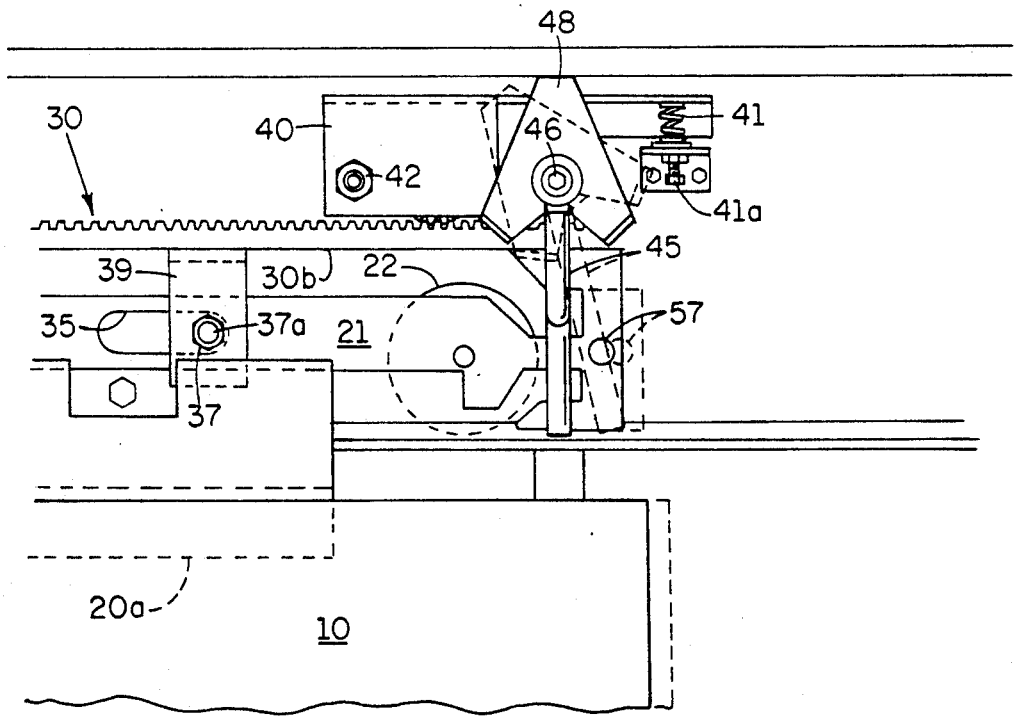

FIG. 9 is a front elevational view of the lever backup operating mechanism, showing the two positions of such mechanism FIG. 10 is a schematic diagram of the energization circuit for an individual cell door motor.

DETAILED DESCRIPTION OF THE PREFERRED EMBODIMENT

Figure 1:
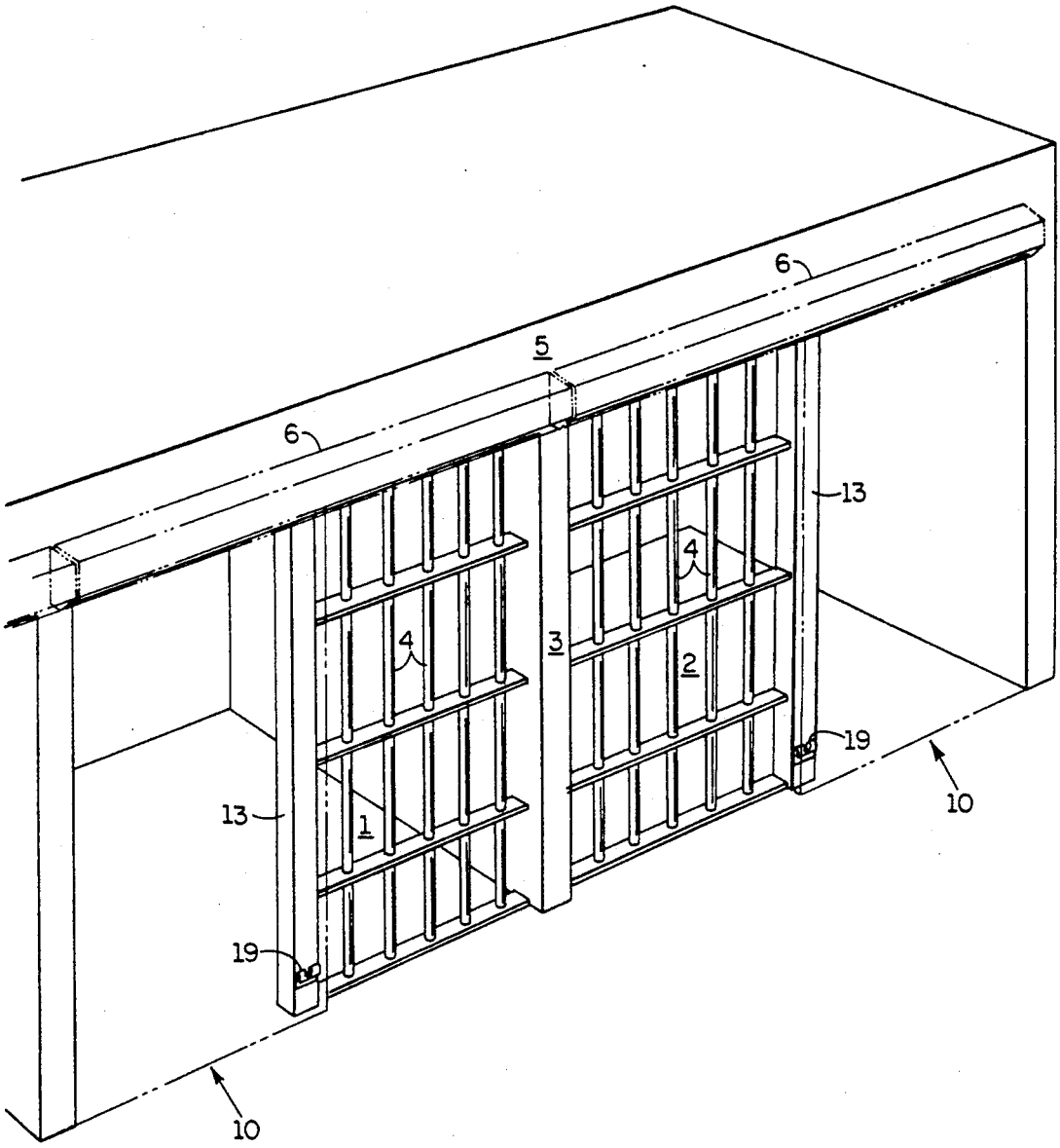
FIG. 1 is a schematic perspective view of a cell door installation embodying this invention for two adjacent cells.

Referring to FIG. 1, there is schematically shown a block of two adjoining cells 1 and 2 having a common wall 3. Cell 1 has a left hand entryway closable by a door 10 while cell 2 has a right hand entryway closable by an identical door 10. Occupant restraining walls 4 close the right hand side of cell 1 and the left hand side of cell 2. Restraining walls 4 respectively extend from a central vertical column 13 in each cell opening to the common wall 3. The top of each cell is defined by a vertical wall 5 to which is attached a steel transom plate 15 (FIG. 2) by suitable bolts. All of the operating mechanism for the respective cell door 10 is mounted on transom plate 15 and enclosed by a steel housing 6 which is only shown by dot-dash lines. It should be understood that not only are the right hand and left hand opening cell doors 10 identical, but also the operating mechanisms, which will, however, be described for only the left hand opening door 10 used for cell 2.

Figure 2:
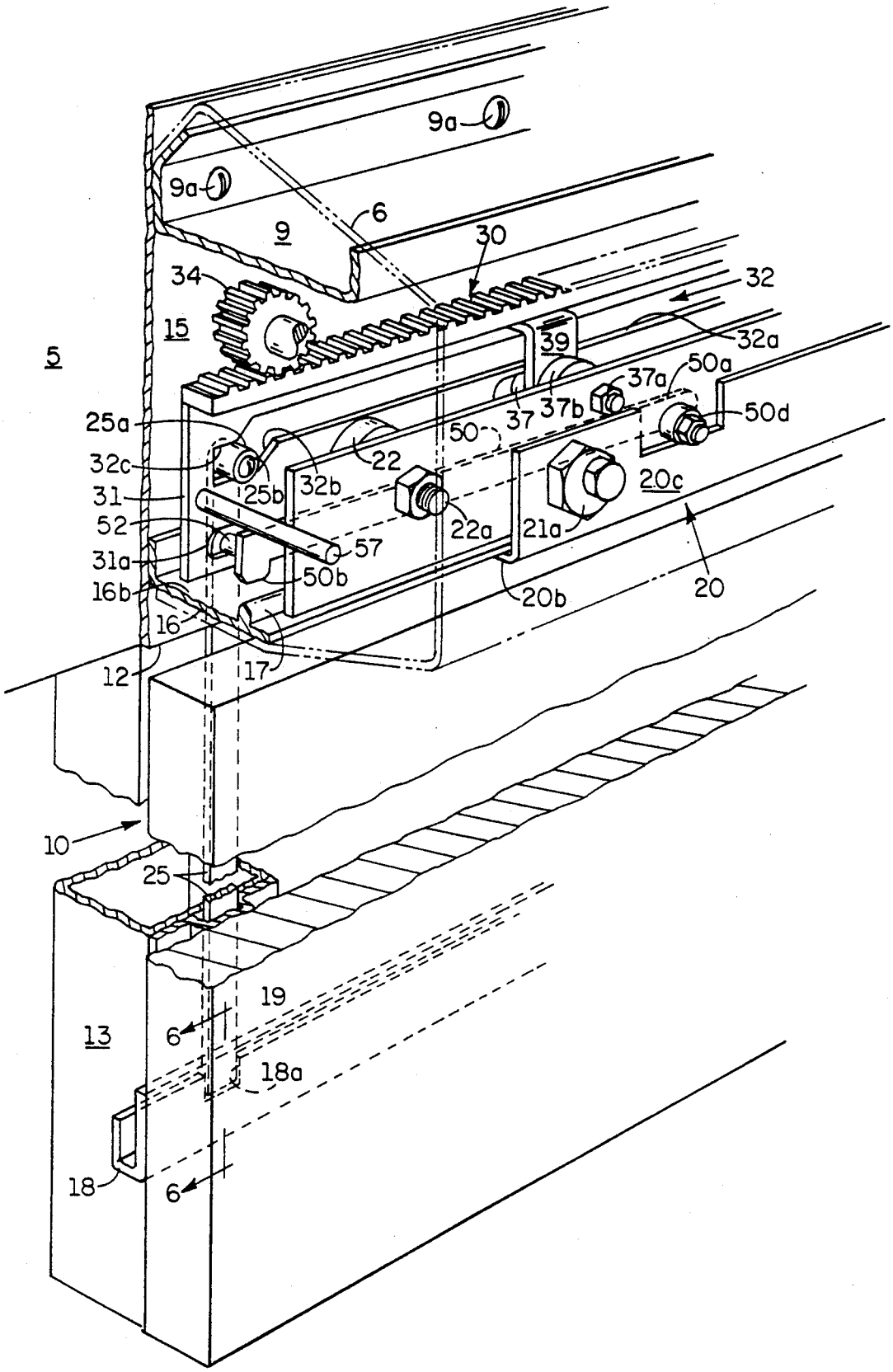
FIG. 2 is a schematic perspective view of the left hand side of a cell door and its operating mechanism embodying this invention, with parts omitted for clarity.

Referring now to FIG. 2, it will be noted that an L-shaped bracket 16 is welded or otherwise rigidly secured by bolts to the lower end of the transom plate 15 and defines a horizontal flange 16*b* which provides a mounting for a horizontally extending track 17. An inverted channel-shaped bracket 9 is also secured by bolts 9*a* to the upper portion of transom plate 15 and provides a mounting for a steel housing 6.

An elongated, generally Z-shaped door hanger 20 is rigidly secured along the upper end of the door 10. Door 10 will be understood to have internal metallic frame elements, both horizontal and vertical (not shown) and metal sheathing on both the inner and outer faces of the door. If desired, an observation window (not shown) may be provided in the door 10.

The Z-shaped door hanger 20 has a vertical portion 20*a* secured to the upper horizontal frame of door 10 and a forwardly projecting horizontal portion 20*b* which underlies the upper frame bracket 16*b* and terminates in an upwardly extending flange 20*c* on which is adjustably mounted a roller mounting plate 21 by eccentric bolts 21*a*. A plurality of rollers 22 are mounted on plate 21 in laterally spaced relationship across the top of the door 10. Rollers 22 cooperate with a track 17 provided on the horizontal flange 16*b* and thus permit the door 10 to be readily rolled from one side of the cell door opening to the other side.

Figure 5:
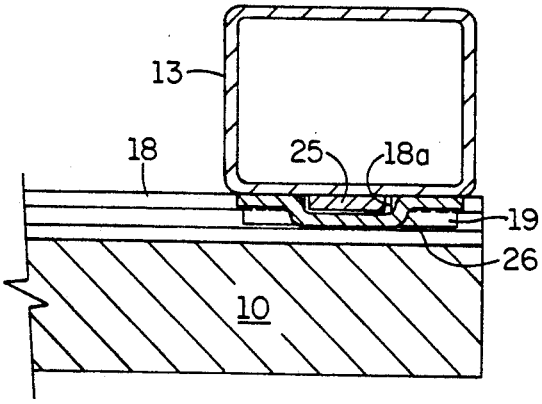
FIG. 5 is a partial sectional view taken on the plane 5—5 of FIG. 4.

It should be noted that in any position, the door 10 overlaps the front face of the center column 13, as clearly shown in FIG. 2. A locking bar 25 is mounted on the front face of column 13 for limited vertical movement. The locking bar 25 is secured by a recessed plate 26 (FIG. 5) which is welded or otherwise rigidly secured to the front face of center column 13. The locking bar 25 extends from a position adjacent the bottom of door 10 to a position above the track flange 16*b* of the bracket 16.

Figure 6:
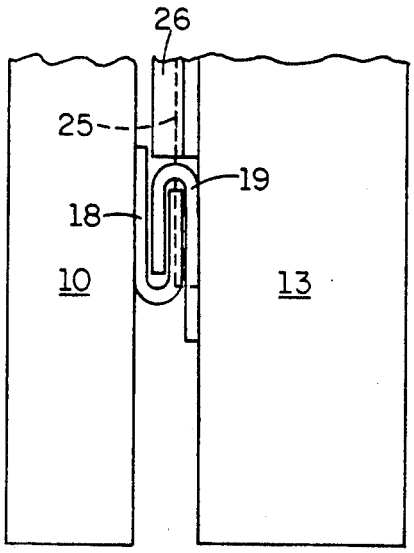
FIG. 6 is a partial sectional view taken on the plane 6—6 of FIG. 2.
Figure 7:
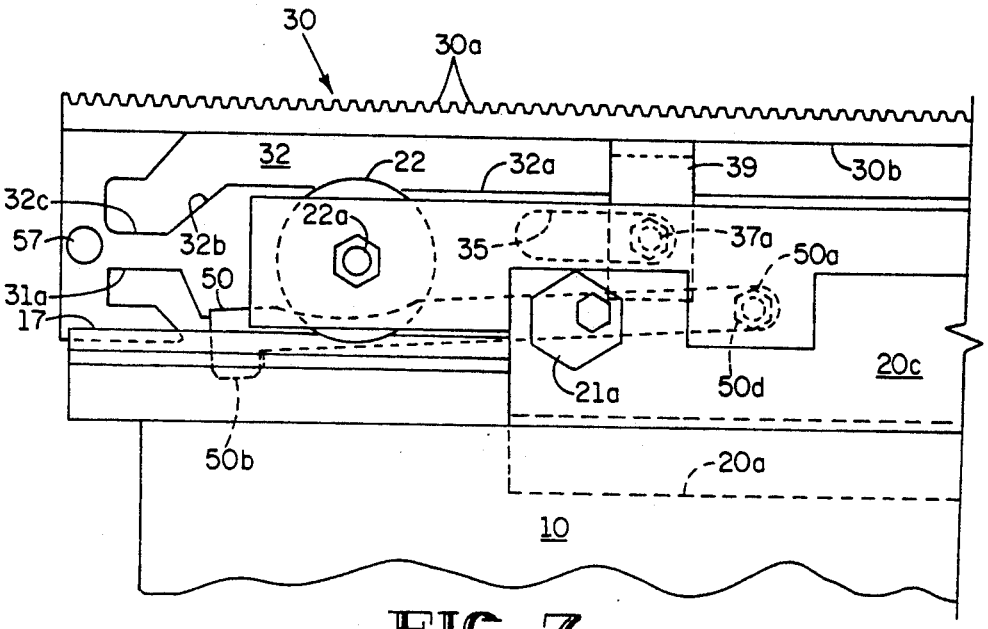

The cell door 10 is provided with a bottom lock frame 18 extending across the bottom region of the door and rigidly secured to a frame member of the door. Lock frame 18 is of U-shaped configuration and is secured to door 10 with its channel facing upwardly. A downwardly opening U-shaped guide 19 (FIG. 6) is secured to the front face of center column 13 and engages in the upwardly opening channel of U-shaped lock frame 18 to restrain the bottom of cell door 10 from lateral movement.

The lock frame 18 is provided at each end with upwardly opening locking notches 18*a* to respectively receive the bottom end of locking bar 25 in locking relation when the cell door 10 is in either its closed position shown in FIG. 1, or its open position (FIG. 2) wherein the right hand locking notch 18*a* is engaged by the locking bar 25.

The locking bar 25 is raised or lowered by a cam slot or track 32 provided on a rack support plate 31 which has a total length greater than the cell door 10 and is slidably mounted on the horizontal flange 16*b*. Cam track 32 is engaged by a roller 25*a* which is journalled on a bolt 25*b* traversing the upper end of locking bar 25. The cam track 32 has an extended medial portion 32*a* which holds roller 25*a* in an elevated position, hence holding locking bar 25 out of both notches 18*a*. At the ends of the cam track 32, the track slopes downwardly as indicated at 32*b* and then extends horizontally a short distance as indicated at 32*c*. When the roller 25*a* enters either of these downwardly sloped portions, the locking bar 25 is urged downwardly into engagement with either the right hand or left hand locking notch 18*a*, depending upon whether door 10 is in its open or closed position.

The rack 30 has a plurality of teeth 30*a* provided on its upper surface which are drivingly engaged by a pinion 34. Pinion 34 is in turn driven by a reversible DC motor 36 through a gear reduction unit 38 (FIG. 8). Pinion 34, the gear reduction unit 38 and the DC motor 36 all secured to a support frame 40 which is pivotally mounted to the transom plate 15 by a pivot bolt 42 (FIG. 9). An adjustable compression spring 41 is preferably provided to urge the support bracket 40 to a position where the pinion 34 will not be engaged with the teeth 30*a* of the rack 30. A cam 48 (to be later described) normally holds the pinion 34 in firm engagement with the rack teeth 32 by engagement with the underside of bracket 9.

Figure 3:
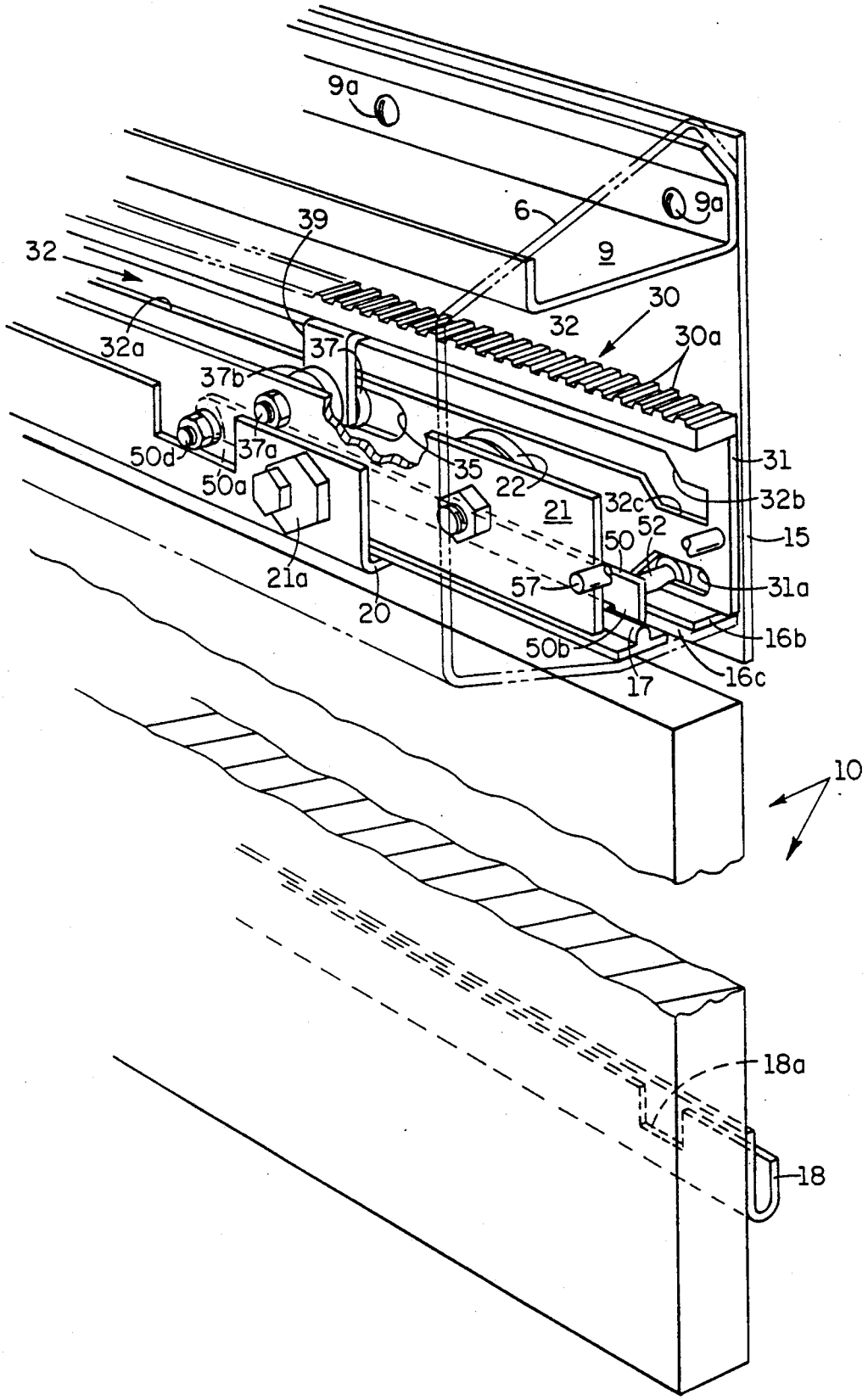
FIG. 3 is a schematic perspective view of the right hand side of a cell door and its operating mechanism embodying this invention with parts omitted for clarity.

The rack 30 is provided with a lost motion connection to the cell door 10. Such lost motion connection may be conveniently provided by a pair of rollers 37 mounted on bolts 37*a* (FIG. 3) which are secured to roller mounting plate 21. Rollers 37 respectively engage limited length slots 35 provided in the rack support plate 31 (FIG. 3). Bolts 37*a* also provide a mounting for spacers 37*b* and rack guide brackets 39 which slidably support the underside 30*b* of the rack 30.

From the description thus far, it will be apparent that whenever the DC motor 34 is energized in the proper direction to either open or close the door 10, the initial movement of the rack 30 is independent of the door 10 due to the lost motion connection. This permits the cam track 32 to lift the locking bar 25 out of engagement with the right hand or the left hand locking notch 16*a*, as the case may be, and free the cell door 10 for movement when the lost motion rollers 37 reach the end of their cooperating slots 35. The door 10 is then moved with the rack 30 to its open or closed position, whereupon the inclined cam portion 32*b* at the other end of the cam track 32 forces the locking rod 25 into engagement with the other locking notch 18*a* and anchors the cell door 10 in its new position, whether that position is open or closed.

It is therefore obvious that the door 10 may be installed in either a right hand or a left hand opening, that the design of the door is entirely symmetrical and no changes are required to accommodate the selected right hand or left hand opening position.

A pair of upper latches 50 are provided on the opposite ends of the vertical flange 20*c* of the Z-shaped door hanger bracket 20. The upper latches 50 (FIGS. 2 and 3) are generally L-shaped with the long end 50*a* of the L being pivotally secured to the roller mounting plate 21 by bolt 50*d* and the short end 50*b* of the L functioning as a latch to engage in one of three notches 16*c* provided in the center and each of the opposite ends of the fixed horizontal flange 16. The positions of the latches 50 are each controlled through the cooperation of a horizontally projecting, headed pin 52 provided on each latch 50 with relatively short cam tracks 31*a* provided in opposite ends of the vertical rack support 31. When the rack 30 is moved in either direction, the cam tracks 31*a* concurrently elevate the latches 50 out of engagement with the notches 16*c* during the lost motion movement of the rack, thus freeing the latches 50 from the latching notches 16*c* so that the cell door 10 is free to move.

Again, the latches 50 function irrespective of whether the cell door operates as a right hand or a left hand opening door.

To prevent burn out of the DC motor in the event that the cell door is accidentally or purposely jammed during its opening or closing motion, the method of this invention contemplates a control circuit for each DC motor which, when a predetermined increase in current flow to a particular motor occurs, a sensor is actuated to operate a relay and disconnect such motor from the 24 volt supply conduit. The same relay functions to initiate the operation of a timing relay which at selected intervals, say from three to five seconds, applies the full 24 volt operating energy to the stalled DC motor for only a few milliseconds. If the same rise in the current above that normally associated with the operation of the cell door occurs, the energization is interrupted for another delay period and then again applied for a few milliseconds. Thus, the blocked condition of the cell door is continuously tested by the electrical circuit, and as soon as the blockage is removed, the DC motor 34 will be continuously energized to produce the desired opening or closing movement of the cell door.

The circuitry for carrying out the aforedescribed method of energization of the reversible DC motors 36 is shown in FIG. 10. Many of the electrical circuit elements can be housed in a control box 58 (FIG. 8) suitably secured to bracket 9 above the rack 30. The entire operating mechanism is enclosed within the generally U-shaped steel cover 6 which is conventionally fastened to flange 16*a* and bracket 9 by bolts requiring a special tool to unfasten.

Referring to the schematic circuit diagram of FIG. 10, it will be noted that preferably at least two battery banks A and B are provided for operating the cell motors 36. For simplicity, only a single cell motor will be shown and a plurality of conventional details, such as lights indicating when a cell door is in its open or closed position, will not be included. A conventional battery charger 70 operable from a 110 volt AC source may be employed and the DC output terminal 72 of the charger 70 is connected to one pole of a two position switch 80. Switch 80 is mechanically coupled by a link 82 to a similar switch 84 and the switches 80 and 84 are thus operated concurrently. The output of battery bank A is connected to terminal 84*a* of switch 84 while the output of battery bank B is connected to terminal 80*a* of switch 80. In the solid line positions of the switches 80 and 84, the battery bank B is connected to the output terminal 72 of battery charger 70. Alternatively, a single battery bank and a well known floating charged can be used for small installations.

The positive or output terminal of battery bank A is connected through switch 84 to an excessive torque detector 90 and a restart timer 92. Both of these units are connected in series with the cell motor 36 through a conventional polarity reversing switch 95. When the cell motor 36 is operating normally and not generating any excessive torque, the restart timer 92 is inoperative. However, when an excessive torque occurs, such as that produced by blocking the cell door, the current drawn by the cell motor 36 sharply increases and this increase in current is sensed by the excessive torque detector 90 and an appropriate relay (not shown) is opened to disconnect the cell motor 36 from the source of DC energy. The restart timer is concurrently activated and such timer functions to periodically, generally at intervals of three to five seconds, apply a normal voltage to the cell motor 36 to determine whether the motor can restart without generating excessive torque. The time period for such energization is on the order of five to ten milliseconds so that there is no danger that the cell motor 36 will be overheated by the successive attempts to restart the motor. When the motor is restarted, without excessive torque, the excessive torque detector restores the normal direct connection to the power source and de-energizes the restart timer. All of these elements are conventional and well known in the art, hence further description is deemed unnecessary. When the switches 80 and 84 are concurrently moved to their dotted line positions shown in FIG. 10, the battery bank B is then disconnected from the battery charger 70 and connected through switch 84 to the excessive torque detector 90 and the restart timer 92 to supply energizing current for the cell motor 34. Concurrently, the battery bank A is connected to the output terminal 72 of the battery charger through the switch 80. It is thus assured that one bank of batteries is always being charged while the other is being employed to operate the cell motors. Thus, the possibility of failure of the system due to discharged batteries becomes minimal.

For simplicity of illustration, switches 80, 84 and 95 have been shown as mechanically operated, however, conventional electronic units would preferably be utilized.

From the foregoing description, it will be readily apparent that the method and apparatus of this invention provides a greatly simplified and much more economical apparatus and method for operating cell doors. The utilization of DC current supplied by batteries substantially eliminates the need for any mechanical backup which heretofore was a necessity since the opening of the cell doors was normally accomplished by utilization of utility supplied AC current.

Figure 4:
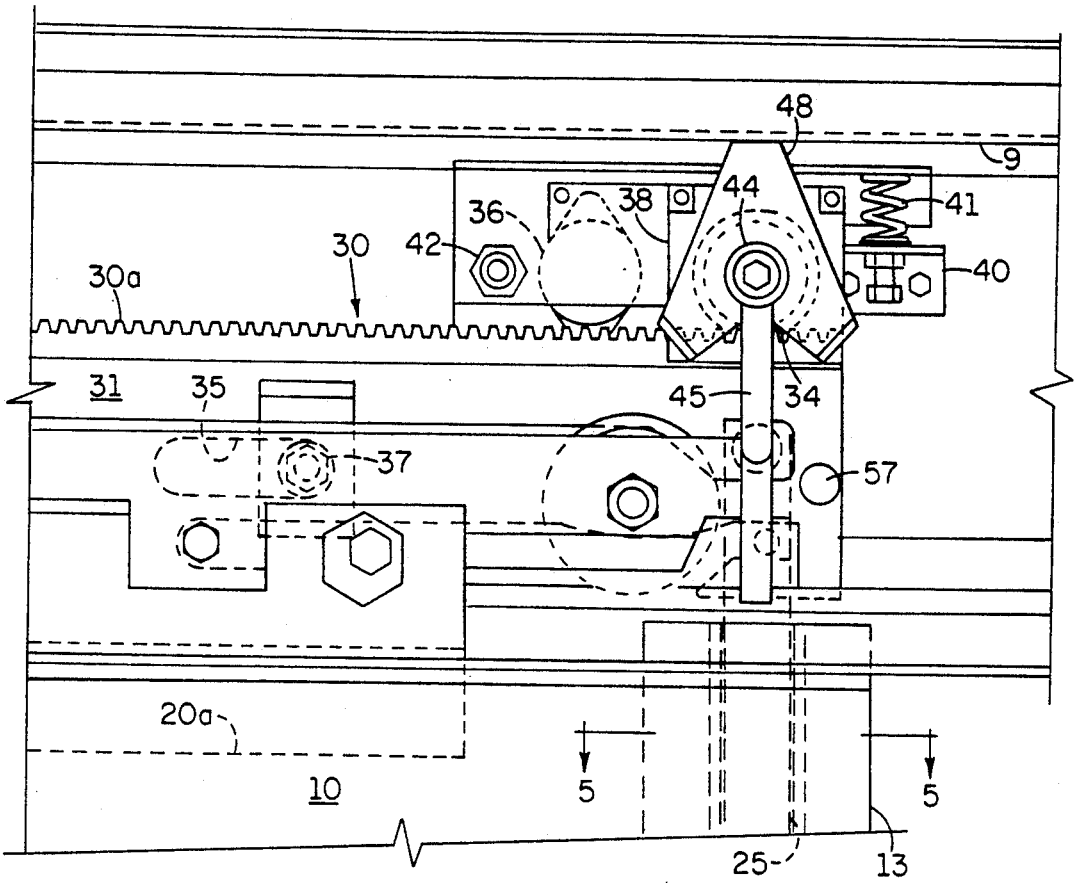
FIG. 4 is a front elevational view of the rack and pinion operating mechanism for the cell door of FIG. 1.

A conventional lever key mechanism for individually operating any cell door can be readily incorporated. As shown in FIGS. 4, 8 and 9, the key operated mechanism comprises a key shaft 60 having an elongated operating handle 62. The key shaft 60 is insertable within a tube 44 which in turn conceals the end of a shaft 46 mounted on the motor support bracket 40. The end face (not shown) of key shaft 60 is shaped to conform to a non-symmetrical end face of shaft 46. Turning the shaft 46 by key shaft 60 in either direction effects the rotation of a cam 48 which releases from engagement with the underside of bracket 9. This permits motor support frame 40 to be pivoted upwardly by spring 41 to elevate the pinion 34 from engagement with the rack 30. Further rotation of the shaft 46 brings a projecting arm 45 secured to the tube 44 into engagement with one of two horizontal rods 57 secured to opposite ends of the front side of the rack supporting bracket 31, thus providing a lost motion connection to the rack 30. The rack 30 is moved through its lost motion distance to effect the unlocking of the vertical locking bar 25 and the end latches 50, thus permitting the cell door 10 to be manually shifted in the selected direction. The required movement of the arm 45 effect the unlocking is indicated by the dotted lines in FIG. 9.

Modifications of this invention will be readily apparent to those skilled in the art and it is intended that all such modifications be included within the scope of the appended claims.

What is claimed and desired to be secured by Letters Patent is:

1. A symmetrical jail cell door assembly for a door opening having a top wall, a floor, two opposed vertical side walls and a fixed, rigid, vertical column dividing the door opening into two substantially equal area right and left halves, comprising, in combination:

a top frame assembly having a vertical base portion and a horizontal flange, with said base portion being securable to said top wall and extending between said vertical side walls;

means on said horizontal flange defining a horizontal roller track;

a rigid rectangular vertical cell door having upper and lower horizontal frame elements interconnected with at least two horizontally spaced, vertical frame members;

a roller support plate secured to said upper frame element;

a plurality of rollers horizontally journalled in spaced relationship along said roller support plate and engaging said roller track to support said cell door for rolling movements between open and closed positions relative to either the right or left half of said door opening;

a locking bar vertically slidably mounted on the said vertical column;

the top end of said locking bar projecting above said horizontal flange and having a horizontally projecting actuator secured thereto;

means secured to said lower horizontal frame element of said cell door defining two upwardly opening horizontally spaced notches respectively engagable by the bottom end of said locking bar when said cell door is positioned in a closed or opened position relative to either the right half or the left half of said door opening;

a rack horizontally disposed above said horizontal flange;

said rack having a lost motion connection with said cell door and defining an elongated cam track extending the full width of said cell door;

said cam track engaging said locking bar actuator to move said locking bar into engagement with a respective one of said upwardly open notches as said cell door approaches its closed position relative to said right or left half of said door opening and to release said locking bar from said respective notch when said rack is moved from said closed position; and motor driven pinion means for horizontally shifting said rack relative to said channel shaped top frame element to selectively open or close said right half or said left half of said door opening.

2. The apparatus of claim 1 further comprising:

resilient means biasing said pinion means out of engagement with said rack;

rotatable cam means for securing said pinion in engagement with said rack;

a key for manually rotating said cam means to permit said resilient means to release said pinion means from engagement with said rack; and lost motion means interconnecting said cam means with said rack to shift said rack by further rotation of said key sufficient to release said locking bar from engagement with one of said upwardly open notches.

3. The apparatus of claim 1 wherein said motor driven pinion means comprises a support pivotally mounted on said top frame assembly adjacent said rack for movement toward and away from said rack;

a motor driven pinion mounted on said support and movable by said support into and out of meshing engagement with said rack;

a cam mounted on said top frame assembly for angular movement about a horizontal axis transverse to the path of movement of said rack and operatively engagable first with said support to move said pinion out of meshing engagement with said rack, an secondly with said rack to shift said rack in the direction to effect unlocking of said cell door; and manually operable key means for angularly shifting said cam.

4. The apparatus of claim 1 wherein said motor driven pinion means comprises a reversible DC motor for driving said pinion means.

5. The apparatus of claim 4 wherein an overload detecting circuit is inserted in series with said DC motor to generate a signal whenever the current flow to said DC motor exceeds that corresponding to a normal torque load on said DC motor; and means responsive to said signal for sequentially de-energizing and then energizing said DC moor for a few milliseconds to determine when the cause of the excess torque on said DC motor has been removed.

6. The apparatus of claim 4 wherein the DC power supplied to said DC motor is supplied by a bank of batteries.

7. The apparatus of claim 6 further comprising means for charging said bank of batteries to maintain said bank substantially fully charged at any time.

8. The apparatus of claim 1 further comprising a pair of horizontally pivoted latches respectively mounted on opposite ends of said roller support plate;

said horizontal flange of said channel shaped top frame element having three horizontally spaced latch receiving means to respectively receive both of said latch elements when said door is in either its closing position with respect to said right half of said door opening or its closing position with respect to said left half of said door opening.

9. The apparatus of claim 8 further comprising cam means on said rack for respectively moving said latches into and out of said latch receiving means as said cell door approaches or leaves a locked position relative to said right or said left half of said-door opening.

10. The apparatus of claim 9 wherein said motor driven pinion means comprises a reversible DC motor.

11. The apparatus of claim 10 wherein the DC power driving said DC motor is supplied by a battery; and charging means for recharging said battery.

12. A horizontally linearly movable, vertical cell door assembly mountable in a cell wall space having opposed vertical walls, a central vertical column, a cell entry passageway extending to one said vertical wall on a selected side of said vertical column and fixed occupant restraining means extending across the space between the other side of the vertical column and said other vertical wall, comprising:

a rigid, horizontal frame element spanning the top end of said cell wall space;

means on said top frame element defining a horizontal track;

a vertical cell door having an inner face and an outer face;

a plurality of rollers rotatably secured in spaced relationship along the top edge of said vertical cell door and located to engage said horizontal track, thereby supporting said cell door for horizontal movement relative to said upper frame element from a closed position spanning said central column and cell entry passageway to an open position spacing said central column and said occupant restraining means;

a locking rod mounted on the outer face of said central column for limited vertical movement and extending from a region above said horizontal track on said upper frame element to a point adjacent the bottom of said vertical cell door;

means adjacent the bottom of said vertical cell door defining a pair of horizontally spaced latching notches respectively receiving the bottom end of said locking bar in said open and closed positions of said vertical door, whereby the same door designs may be employed for a cell entry passageway on either side of said central column;

an elongated horizontal rack mounted for horizontal movement on said top frame element;

means on said rack defining an elongated cam track extending horizontally beyond said locking rod in both said open and closed positions of said vertical cell door;

actuator means connecting said locking rod to said cam track;

said cam track being contoured to shift said locking rod downwardly into engagement with a respective one of said latching notches when said vertical cell door moves into either said open or closed positions;

lost motion means interconnecting said elongated rack to the top end of said cell door, whereby initial movement of said rack in either direction relative to said locking bar releases said locking bar from a respective one of said notches prior to moving said cell door;

a pinion driving said rack;

a reversible DC motor driving said pinion; and a DC power source for said DC motor comprising a selected one of two independent banks of batteries.

13. The apparatus of claim 12 further comprising means for alternately charging said two banks of batteries to maintain one bank substantially fully charged at any time.

14. The apparatus of claim 12 further comprising:

resilient means biasing said pinion out of engagement with said rack;

rotatable cam means for securing said pinion in engagement with said rack;

a key for manually rotating said cam means to permit said resilient means to release said pinion from engagement with said rack; and lost motion means interconnecting said cam means with said rack to shift said rack by further rotation of said key sufficient to release said locking bar from engagement with one of said upwardly open notches.

15. The apparatus of claim 14 comprising:

a pair of latches horizontally pivotally secured to opposite ends of said upper frame element of said cell door;

said top frame element having latch receiving means in its opposite ends and in its center to receive both of said latch elements when said door is in either its closing position with respect to said right half of said door opening or its closing position with respect to said left half of said door opening; and cam means on said rack for respectively moving said latch elements out of said latch receiving means by the movement of said rack by said key.

16. A horizontal linearly movable, vertical cell door assembly mountable in a cell wall space having opposed vertical walls, a central vertical column, a cell entry passageway extending to one said vertical wall on a selected side of said vertical column and fixed occupant restraining means extending across the space between the other side of the vertical column and said other vertical wall, comprising;

a rigid, horizontal frame element spanning the top end of said cell wall space;

means on said top frame element defining a horizontal track;

a vertical cell door having an inner face and an outer face;

a plurality of rollers rotatably secured in spaced relationship along the top edge of said vertical cell door and located to engage said horizontal track, thereby supporting said cell door for horizontal movement relative to said upper frame element from a closed position spanning said central column and cell entry passageway to an open position spacing said central column and said occupant restraining means;

a locking rod mounted on the outer face of said central column for limited vertical movement and extending from a region above said horizontal track on said upper frame element to a point adjacent the bottom of said vertical cell door;

means adjacent the bottom of said vertical cell door defining a pair of horizontally spaced latching notches respectively receiving the bottom end of said locking bar in said open and closed positions of said vertical door, whereby the same door designs may be employed for a cell entry passageway on either side of said central column;

a pair of horizontally pivoted latches respectively secured to opposite ends of said upper frame element of said cell door;

said top frame element having latch receiving means in its opposite ends and in its center to receive both of said latch elements when said door is in either its closing position with respect to said right half of said door opening or its closing position with respect to said left half of said door opening.

17. The apparatus of claim 16 further comprising cam means on said rack for respectively moving said latch elements into and out of said latch receiving means as said cell door approaches or leaves a locked position relative to said right half or said left half of said door opening.

18. The method of operating a cell door comprising the steps of:

providing a reversible electric motor operatively connected to a power source and to the cell door to move it between closed and opened positions;

detecting the level of current drawn by said motor;

activating a special control sequence upon detection of a motor current level indicating a significant increase in torque output of said motor above normal levels required for moving said cell door;

said special control sequence comprising the repeated application of normal voltage to said motor for a minimal duration of milliseconds so long as the torque output of said motor exceeds normal levels.

19. The method of claim 18 wherein said electric motor is a reversible DC motor and said power source comprises a bank of batteries; and further comprising the step of:

automatically charging said battery bank.

* * * * *